United States Patent [19]

Kallman et al.

[11] Patent Number: 4,796,317

[45] Date of Patent: Jan. 10, 1989

[54] DUST RUFFLES FOR A BED

[76] Inventors: Robert Kallman, 2030 Haring St., Brooklyn, N.Y. 11229; Mark Henderson, 8 School Ave., Chantham, N.J. 07928

[21] Appl. No.: 114,628

[22] Filed: Oct. 28, 1987

[51] Int. Cl.[4] ..... A47G 9/04

[52] U.S. Cl. ..... 5/493; 24/72.5

[58] Field of Search ..... 5/493, 496, 498, 482; 24/72.5; 160/330

[56] References Cited

U.S. PATENT DOCUMENTS

| | | | |
|---|---|---|---|
| 524,834 | 8/1894 | Mayent | 24/72.5 |
| 1,147,616 | 7/1915 | Dennison | 5/498 |
| 4,587,683 | 5/1986 | Gardiner | 5/493 |

*Primary Examiner*—Alexander Grosz

*Attorney, Agent, or Firm*—Edwin D. Schindler

[57] ABSTRACT

A set of bed ruffles, preferably made of cloth, which has along its upper, unruffled border, i.e., perimeter, a mesh or screen, is disclosed. The mesh is, preferably, made of a durable, but flexible plastic. The mesh affixed to the ruffles is to be releasably attached to attachment means located on the box spring of the bed. Such attachment means are, preferably, a sphere which may either be permanently or temporarily affixed to the box spring or mattress of the bed. When a user wishes to decorate a bed with the ruffles of the present invention, a user need simply lift a portion of a top mattress and affix the mesh, having the ruffles, to the attachments means which would have been previously secured to the box spring. The mesh would be affixed around, usually, three sides of the perimeter of the box spring.

7 Claims, 2 Drawing Sheets

Fig. 4.
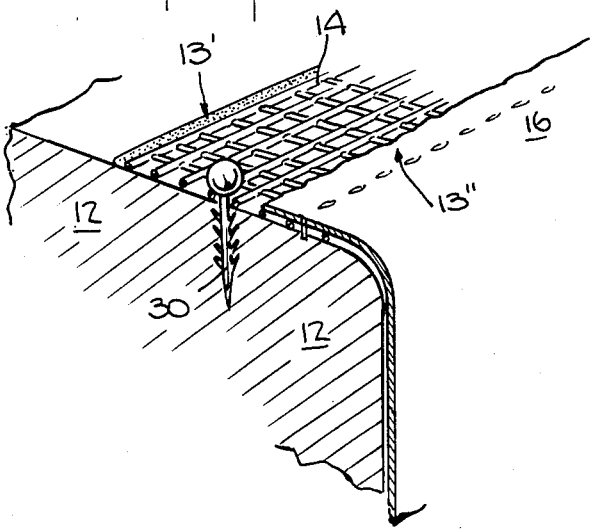
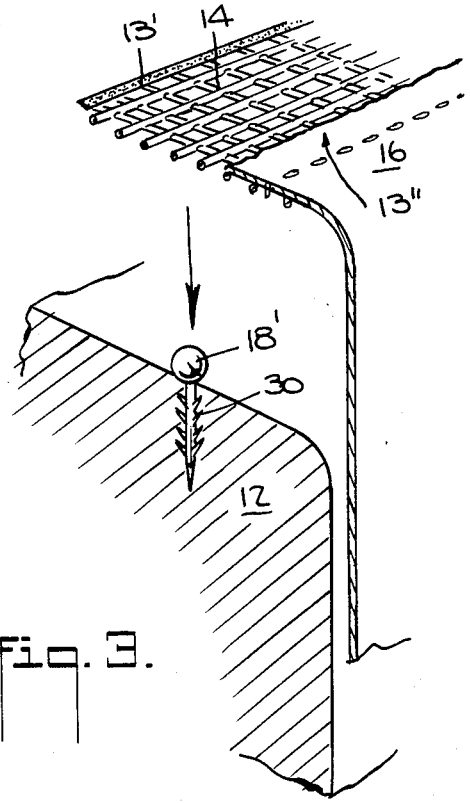
Fig. 3.
Fig. 5.
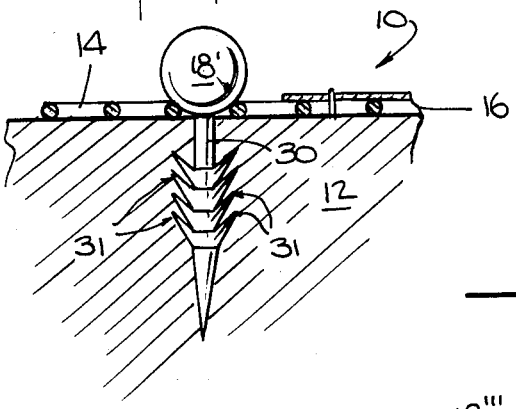
Fig. 6.
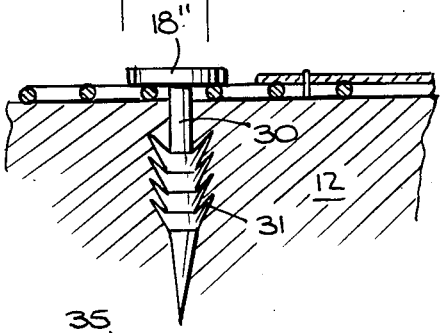
Fig. 7.
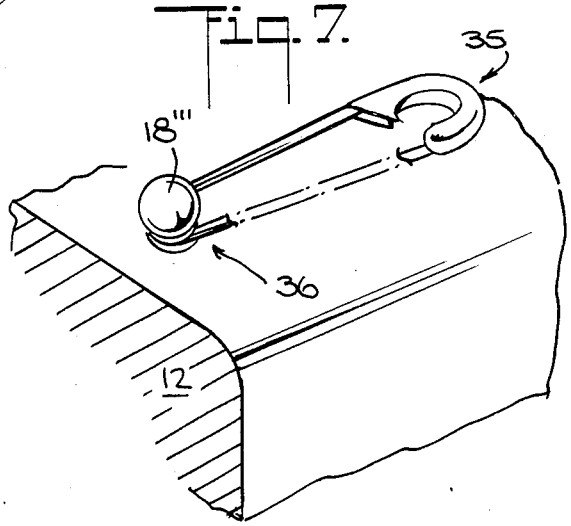

DUST RUFFLES FOR A BED

BACKGROUND OF THE INVENTION

1. Field of the Invention

The present invention relates to decorative dust ruffles for a bed. More particularly, the invention relates to bed dust ruffles, or valance, which may be easily and conveniently placed on a bed, and which are adjustable to any size bed,, without the need of removing the top mattress or otherwise specifically tailoring a particular sized dust ruffle to a particular bed.

2. Descriotion of the Prior Art

Heretofore, the placement of dust ruffles around three sides of a box spring, lying beneath a conventional mattress, normally required the complete removal or displacement of the top mattress from the box spring. The dust ruffles of the prior art were affixed to the perimeter of a sheet. This sheet, of a fixed length and width, had to be properly placed over the box spring. A set of dust ruffles in the prior art device was adaptable to only a mattress of a particular length and width. This is because the length and width of the sheet with the dust ruffles had to match the dimensions of the box spring. Even with a properly sized sheet, the placement of the dust ruffles around the box spring was often quite time consuming and tedious.

Other methods used included a dust ruffles skirt with an elastic top edge that is held in place by the pressing weight of the mattress. Additionally, the use of safety pins, snaps, corkscrew pins and two point Velcro type fasteners are used to position a dust ruffle or top edge around the top of the box spring or foundation. After each of these dust ruffle removals and replacements, careful tedious repositioning and fastening is necessary. Another two-part system in the prior art uses one part of a zipper along the top edge of the dust ruffle and another around the perimeter of a sized mattress pad. Such zipper systems are very expensive because they require numerous sizes to adjust to the different bed sizes and mattress thickness. Of all the aforesaid prior art devices for the fitting of dust ruffles around a bed, no prior art device offers both an easy and inexpensive method for accomplishing the same.

Representative of the prior art include the patents to Piontkowski, U.S. Pat. No. 2,763,875, issued Sept. 25, 1956; Weinberg, U.S. Pat. No. 2,619,658, issued Dec. 2, 1952; and, Hoit, U.S. Pat. No. 1,270,414, issued June 25, 1918.

SUMMARY OF THE INVENTION

Accordingly, it is an object of the present invention to provide bed dust ruffles which are capable of placement along the perimeter of a box spring which may be set in place quickly and conveniently without the need to remove the top mattress from the box spring.

It is a further object of the present invention to provide dust ruffles for a bed which are adjustable to fit box springs or mattresses of greatly varying sizes.

It is, yet, another object of the invention to provide a set of bed dust ruffles which is economical to manufacture.

It is an additional object of the invention to provide decorative bed dust ruffles which overcome the disadvantages inherent in the prior art.

The foregoing and related objects are accomplished by a set of bed dust ruffles, preferably made of cloth, which has along its upper, unruffled border, i.e., perimeter, a mesh or screen. The mesh is, preferably, made of a durable, but flexible, plastic. The mesh affixed to the dust ruffles is to be releasably attached to attachment means located on the box spring. Such attachment means are, preferably, a sphere which may either be permanently or temporarily affixed to the box spring or mattress of the bed.

When a user wishes to decorate a bed with the dust ruffles of the present invention, a user need simply lift a portion of a top mattress and affix the mesh, having the dust ruffles, to the attachment means which would have been previously secured to the box spring. The mesh would be affixed around, usually, three sides of the perimeter of the box spring. When turning a corner of the box spring, as the user continues to attach the mesh to the means for attachment, the user need only fold-over the mesh, pleating the corner, before continuing to attach the mesh to the box spring in its new 90-degree direction. The precise means for attaching the mesh to a box spring will be explained in greater detail hereinafter by reference to the drawing.

The openings of the mesh, which are preferably attached to the attachment means of the invention by an interference fit, exist in rows and columns. By preferably, having a plurality of openings in the width of the mesh, it is possible to adjust and re-adjust the height of the dust ruffles to a bed of any height. Of course, a plurality of openings along the width of the mesh is not required if one wishes to design the bed dust ruffles of the invention to a specific height.

The present invention will now be explained in greater detail with reference being made to the accompanying drawing. It should, however, be pointed out that the drawing, while illustrative of the invention, does not define the scope and limitations of the invention.

BRIEF DESCRIPTION OF THE DRAWING

In the drawing, wherein similar reference numerals denote similar features. throughout the several views:

FIG. 3 is a perspective view illustrating the mesh of the invention and a preferred means for attachment by a box spring, prior to said attachment;

FIG. 4 is a perspective view showing the mesh of the invention removably attached to a preferred means for attachment of FIG. 3;

FIG. 5 is an elevational view illustrating the preferred means of attachment shown in FIGS. 3 and 4;

FIG. 6 is an elevational view illustrating another preferred means for attachment of the mesh to a box spring; and FIG. 7 is a perspective view of yet another preferred means for attachment of the mesh of the invention to a box spring.

DETAILED DESCRIPTION OF THE DRAWING

Figure 1:
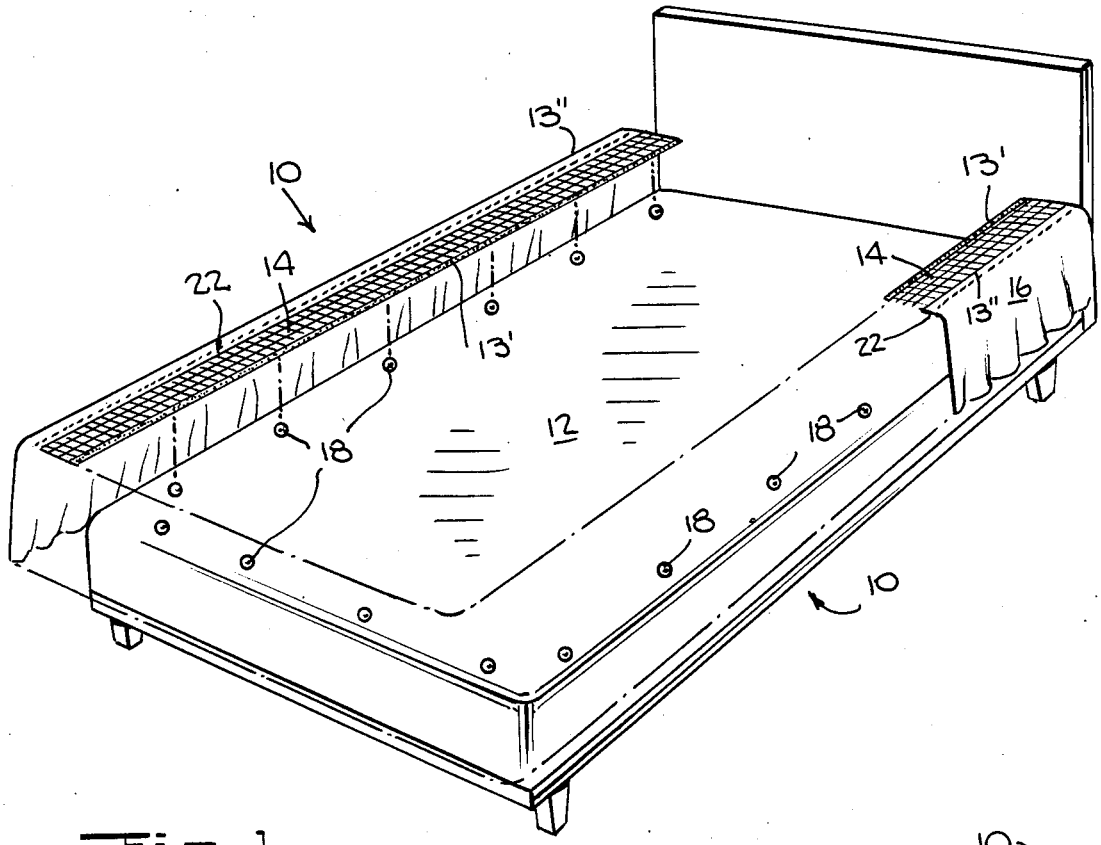
FIG. 1 is a perspective view of the bed with a box spring thereon, illustrating how the mesh, with its dust ruffles, would be attached to the attachment means of the present invention.

Turning now, in detail, to the drawing, FIG. 1 is a perspective view illustrating a bed 10, with box spring 12, and how mesh 14 (partial view), having attached thereto a set of dust ruffles 16, would be placed around bed 10 prior to attachment to attachment means 18. Attachment means 18 may either be permanently or temporarily affixed to either the top, a side or the bottom of box spring 12. Preferably, the means for attachment 18 of mesh 14 is along the top of box spring 12 in the manner illustrated. It should be pointed out that one may either position the mesh 14 around the edges of box spring 12 or, preferably attach mesh 14 to box spring 12 via attachment means 18 as one progresses systematically around bed 10 to both position mesh 14 and, concurrently therewith, attach mesh 14 to attachment means 18.

Mesh 14 of the invention is, preferably, a grid, having rows and columns of openings, and made of a flexible and, preferably, durable material, which could nevertheless be cut with a pair of scissors. The mesh 14, preferably made of a plastic, is most clearly illustrated in FIGS. 3 and 4. Dust ruffles 16 are to be attached for the entire length on one side of mesh 14 by conventional means, such as having mesh 14 sewn to, or into upper edge 22 of dust ruffles 16, or by having mesh 14 glued to dust ruffles 16.

Figure 2:
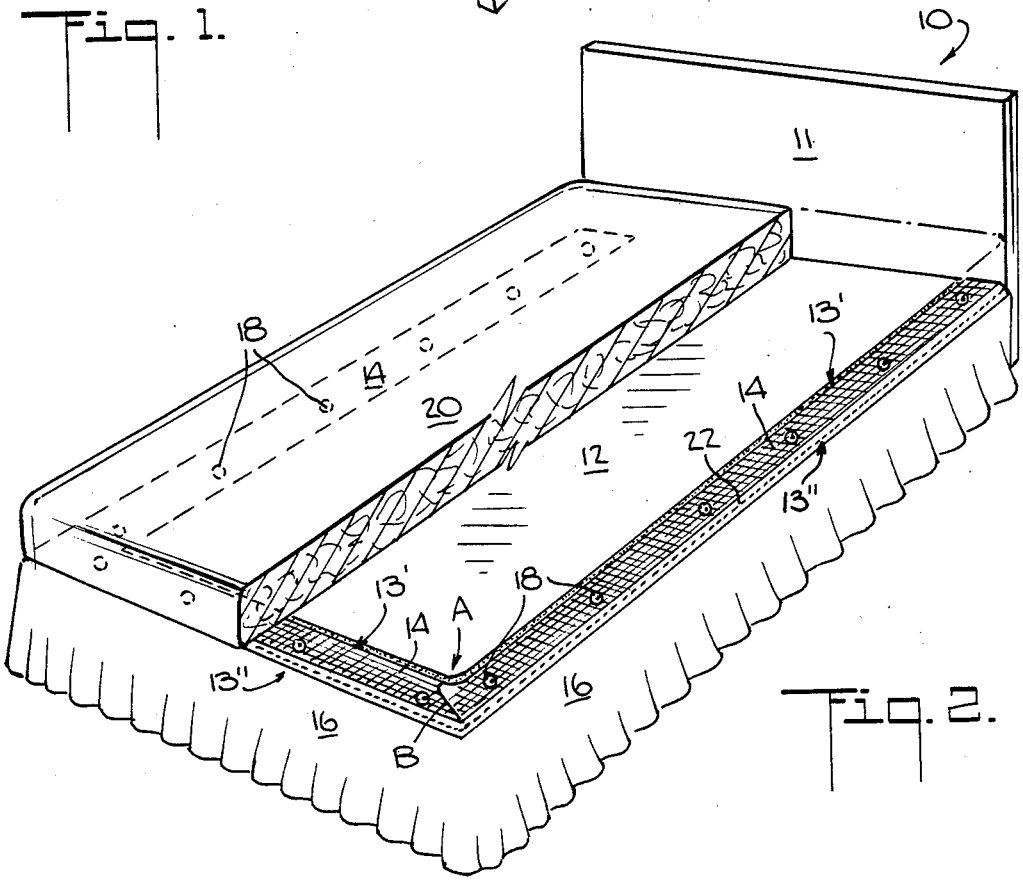
FIG. 2 is a perspective view of the bed and box spring of FIG. 1, following attachment of the mesh of the invention to the attachment means of the invention, with a partial view of a top mattress atop of the box spring.

FIG. 2 is a perspective view showing the attachment of mesh 14 removably attached to attachment means 18 which, in turn, is affixed to box spring 12. A cut-away view of a mattress 20 is presented in FIG. 2. Attachment of mesh 14, with dust ruffles 16, to attachment means 18 is carried out as follows: Initially, one must decide, in view of the height of a bed, the height at which dust ruffles 16 are to be suspended above the ground or floor. Mesh 14, as clearly shown in FIGS. 3 and 4, is a grid, preferably, having columns and rows of openings. The rows of the mesh, which arbitrarily run perpendicular to the upper edge 22 of dust ruffles 16, which is attached to mesh 14, preferably have a plurality of openings, e.g., 8–12 openings per row. The columns of openings in mesh 14, for the purposes of discussion, run parallel to the upper edge 22 of the dust ruffles. If one wants the dust ruffles of the invention to hang a considerable height down from the top mattress 20 of bed 10, perhaps because bed 10 is relatively large, then one should seek to attach mesh 14 through an opening in a row which is a large number of openings away from upper edge 22. Conversely, if one wishes to have dust ruffles 16 extend, relatively speaking, only a short distance from the top mattress, one should seek attachment of mesh 14 to attachment means 18 at an opening that is relatively close to edge 22 of dust ruffles 16. So that the dust ruffles 16 of the invention are displayed at an even height from the bed, one should seek to attach mesh 14 to attachment means 18 by a series of openings which are all the same number of openings in their respective rows from edge 22.

Actual attachment of mesh 14 to attachment means 18 occurs by pressing or otherwise forcing an opening of mesh 14 over attachment means 18 so that the mesh of the invention is removably affixed to the means for attachment in a fashion somewhat similar to which one buttons a shirt. The use of a spherical or elipsoid shaped head or top distal end provides a simple vertical release or attachment in deference to a flat button-type head which requires complex twisting in order to obtain release or attachment. One would proceed to attach mesh 14 at various points around the perimeter of the box spring 12. Usually, as shown in FIG. 2, one would attach the mesh of the invention around three sides of box spring 12; excluding the side of the box spring which closely parallels the headboard 11 of the bed.

As one proceeds around the bed 10, systematically affixing mesh 14 to attachment means 18, which in turn is affixed to box spring 12, one may freely turn a corner of the bed (A) and simply continue the attachment process. As a result of turning a corner of bed 10, one will find that a triangular segment, designated by the reference letter B, will be formed, i.e., a pleat. This triangular segment may either be left free, to eventually be covered by top mattress 20, or this triangular segment may itself be attached to one of the means for attachment 18. There is no need to cut or otherwise design the dust ruffles of the invention to the length or width of a particular bed. Moreover, when the attachment process around bed 10 is completed, one may either cut the excess portion of the mesh and dust ruffles off, if any, or may simply "backtrack" underneath along the perimeter of the box spring to continue the attachment process until the excess mesh and dust ruffles are fully attached and folded under forming a double layer.

To remove the mesh 14 with dust ruffles 16 from attachment means 18, one need simply pull, or otherwise apply pressure to the mesh 14 away from the attachment means 18 in order to free the mesh and remove dust ruffles 16 from bed 10.

FIGS. 1–4 also show the preferable inclusion of an anti-sag strip 13′ and 13″ along the upper and/or lower perimeter, respectively, of mesh 14. The purpose of said strips is to reduce the number of attachment points of the mesh to, for example, the bed.

It should be pointed out that a flexible mesh, as shown in the drawing, is merely the preferred means for carrying out the present invention. In addition, one may employ, instead of a mesh, as an unruffled attachable upper border for the dust ruffles, a row of bottons.

FIGS. 3–7 show in detail several types of means for attaching (18) mesh 14 to box spring 12. FIGS. 3–5 show sphere 18′ atop of a pointed rod 30 having a plurality of upwardly extending points (31) therefrom. The attachment means (18′) shown in FIGS. 3–5 is intended to be permanently embedded into a box spring. Points 31 would make removal of attachment means 18′ from box spring 12 extremely difficult. Initially, a user of the present invention would affix the attachment means around the perimeter of a box spring. If the attachment means shown in FIGS. 3–6 are employed, the attachment of the attachment means would likely be permanent. Thereafter, one would temporarily affix mesh 14 to the attachment means by pressing mesh 14 in the manner shown in FIG. 3, with the result thereof shown in FIG. 4. It should be pointed out that the attachment means are preferably affixed to the top side of box spring 12, though, conceivably, they could be affixed along a side of the box spring.

As alluded to above, the attachment means 18′ shown in FIG. 6 is of a similar nature to the means shown in FIGS. 3–5, in the sense that it is intended to be permanently embedded into the box spring. Attachment means 18″ differs from the means shown in FIGS. 3–5 by having a conventional button, which is to engage the mesh, rather than a sphere. While a button, sphere or any suitable attaching means may be used to engage the mesh 14 to the attachment means, a sphere or slight elipsoid shape is the preferred mode since it has been found to permit the quickest attachment and removal of the mesh from the box spring.

Finally, FIG. 7 illustrates a non-permanent attachment means 35, in the sense that the attachment means shown in FIG. 7 is not intented to be permanently embedded into the box spring 12. Such attachment means 35 is a removably safety pin, having attached (e.g., glued), at its closed end 36, a sphere 18'''. A button (not shown) or any other shaped object for engagement with mesh 14 may be affixed to safety pin 35. In this fashion, this attachment means can be applied to a bed box type foundation, i.e., a foundation utilizing a hard board below a foam and fabric, ticking surface.

Moreover, a safety pin is by no means the only non-permanent mode for affixation of attachment means 18 to mesh 14. A pin, intended for removal, unlike rod 30, may be utilized.

The present mesh fastening system may be also as a means for adjustably attaching drapes rods or curtain rods with spherical fastening means as disclosed herein.

While only several embodiments or the present invention have been shown and described, it will be obvious to those skilled in the art that various modifications may be made to the present invention without departing from the spirit and scope thereof.

What is claimed is:

1. A valance for a bed, comprising:

a ruffled portion; and, an unruffled portion attached to said ruffled portion, said unruffled portion comprising a flexible mesh material in combination with fastener means adapted to penetrate the apertures of said flexible mesh material to thereby fasten said valance to portions of said bed.

2. The valance for a bed according to claim 1, wherein said unruffled portion contains a series of openings for a removable attachment of said unruffled portion to said ruffled portion.

3. The valance for a bed according to claim 1, wherein said flexible mesh material is plastic.

4. The valance for a bed according to claim 1, wherein said unruffled portion includes a plurality of spheres attachable to said bed whereby said unruffled portion is capable of removable attachment to said bed.

5. The valance for a bed according to claim 4, wherein said plurality of spheres is permanently attachable to said bed.

6. The valance for a bed according to claim 4, wherein said plurality of spheres is non-permanently attachable to said bed.

7. The valance for a bed according to claim 1, wherein said unruffled portion includes an anti-sag portion which is more rigid than said flexible mesh material.

* * * * *